US007784444B2

(12) United States Patent
Bohlmann et al.

(10) Patent No.: US 7,784,444 B2
(45) Date of Patent: Aug. 31, 2010

(54) ACTUATING DRIVE FOR ACTUATING A FUEL INJECTION VALVE

(75) Inventors: Tim Bohlmann, Zeitlarn (DE); Michael Denzler, Regensburg (DE); Stefan Kohn, Hohenburg (DE); Yavuz Kurt, Cham (DE); Klaus Plecher, Zeitlarn (DE); Emanuel Sanftleben, Pfatter (DE); Marcus Unruh, Zeitlarn (DE); Claus Zumstrull, Regenstauf (DE)

(73) Assignee: Continental Automotive GmbH, Hannover (DE)

( * ) Notice: Subject to any disclaimer, the term of this patent is extended or adjusted under 35 U.S.C. 154(b) by 526 days.

(21) Appl. No.: 11/908,756

(22) PCT Filed: Mar. 21, 2006

(86) PCT No.: PCT/EP2006/060916

§ 371 (c)(1),
(2), (4) Date: Sep. 14, 2007

(87) PCT Pub. No.: WO2006/100242

PCT Pub. Date: Sep. 28, 2006

(65) Prior Publication Data

US 2008/0163853 A1 Jul. 10, 2008

(30) Foreign Application Priority Data

Mar. 24, 2005 (DE) ..... 10 2005 013 911

(51) Int. Cl.
*F02M 51/06* (2006.01)
*B05B 1/08* (2006.01)

(52) U.S. Cl. ..... 123/472; 239/288.3; 251/129.06

(58) Field of Classification Search ..... 123/472, 123/498; 251/129.06; 239/288.3, 102.1, 239/585.1, 102.2, 102.6
See application file for complete search history.

(56) References Cited

U.S. PATENT DOCUMENTS

| | | | | |
|---|---|---|---|---|
| 6,705,587 | B1 * | 3/2004 | Frank et al. | 251/129.06 |
| 7,175,105 | B2 | 2/2007 | Plecher | |
| 2002/0090506 | A1 | 7/2002 | Protzner | |
| 2006/0038030 | A1 | 2/2006 | Plecher | |

FOREIGN PATENT DOCUMENTS

| | | |
|---|---|---|
| DE | 198 44 743 | 6/2000 |
| DE | 19844743 C1 | 6/2000 |
| DE | 10053681 A1 | 5/2002 |
| DE | 102 51 225 | 5/2004 |

(Continued)

OTHER PUBLICATIONS

International Search Report & Written Opinion for Application No. PCT/EP2006/060916 (10 pages), Jun. 19, 2006.

*Primary Examiner*—Hieu T Vo
(74) *Attorney, Agent, or Firm*—King & Spalding L.L.P.

(57) ABSTRACT

A protective cover for an actuating drive, that can be used as universally as possible, for components (14, 16) of a contacting and/or sealing arrangement of the actuating drive. The sealing arrangement is embodied in a liquid-tight but gas-permeable manner and ends in a cavity on the outer side, the cavity being covered by a cover (28) held on the actuating drive by means of a catch connection (30, 32).

20 Claims, 4 Drawing Sheets

FOREIGN PATENT DOCUMENTS

| | | | |
|---|---|---|---|
| DE | 10251225 | A1 | 5/2004 |
| EP | 1 193 391 | | 4/2002 |
| EP | 1193391 | A1 | 4/2002 |
| EP | 1 628 016 | | 2/2006 |
| EP | 1628016 | A1 | 2/2006 |
| WO | 2004/042226 | | 5/2004 |

* cited by examiner

ACTUATING DRIVE FOR ACTUATING A FUEL INJECTION VALVE

CROSS-REFERENCE TO RELATED APPLICATIONS

This application is a U.S. national stage application of International Application No. PCT/EP2006/060916 filed Mar. 21, 2006, which designates the United States of America, and claims priority to German application number 10 2005 013 911.6 filed Mar. 24, 2005, the contents of which are hereby incorporated by reference in their entirety.

TECHNICAL FIELD

The present invention relates to an actuating drive and to a fuel injector formed therewith.

BACKGROUND

An actuating drive of this type is known, for example, from DE 102 51 225 A1. In this prior art a fuel-resistant sealing ring (O-ring) is inserted in openings of a head plate placed on the piezo actuator in order to create a permanent, in particular oil-tight, seal between a piezo actuator and an external terminal. Furthermore, a sleeve of insulating material, which effects centering and electrical insulation of the contact pin, is inserted in each opening below the sealing ring.

A further contacting arrangement for electrically connecting contact pins of a piezo actuator to laterally projecting connection pins of an external connection device is known, for example, from DE 198 44 743 C1. This publication describes a contact carrier with bores for the contact pins to pass through and with welding lugs arranged adjacent to the bores in such a way that they can be welded to the protruding contact pins. The welding lugs of the contact carrier are connected electrically to laterally projecting contacts which can therefore be used for external connection of the finished fuel injector. After welding of the contact pins to the welding lugs, in this prior art the manufacturing step of injection-molding plastics material around the upper side of the contact carrier is provided.

The known injection-molding around a contacting and/or sealing arrangement on an actuating drive is comparatively simple to execute and advantageously protects the actuating drive components located underneath.

A disadvantage of the known covering by means of injection-molding, however, is that the actuating drive components covered by the injection-molded plastics material frequently have to be configured in a special way (with increased complexity and cost). For example, in the contact carrier according to the above-mentioned DE 198 44 743 C1, special sealing of the bores of the contact carrier against ingress of plastics material during injection molding is provided.

Independently of this, it has emerged, especially in the case of actuating drives with a piezo actuator, that the service life of the actuator tends to be negatively influenced by sealing elements for sealing the actuator space, and by final injection molding of plastics material around the contacting and/or sealing arrangement, and thus by the more-or-less hermetic sealing of the actuator.

SUMMARY

A protective cover for components of a contacting and/or sealing arrangement of an actuating drive for actuating a fuel injection valve, which cover can be used as universally as possible can be created by an actuating drive for actuating a fuel injection valve, comprising a sleeve-shaped actuator housing with a piezo actuator contained therein, from which piezo actuator contact pins project from an end opening of the actuator housing, a connecting device for electrically connecting the contact pins of the piezo actuator to connecting pins of an external connection device formed by the connecting device, and a sealing arrangement for sealing the end opening of the actuator housing against ingress of liquid media, wherein the sealing arrangement is embodied in gas-permeable form and opens on the outside into a cavity which is covered by a cover retained on the actuating drive by means of a catch connection.

According to an embodiment, the cover may have latching projections and/or latching openings which cooperate for latching with latching openings and/or latching projections provided correspondingly on an integral plastics injection molding. According to a further embodiment, the integral plastics injection molding annularly may surround an end section of a lateral face of the sleeve-shaped actuator housing and may form a collar projecting beyond the end opening of the actuator housing in the axial direction. According to a further embodiment, the corresponding latching openings and/or latching projections of the integral plastics injection molding may be provided on the collar of the integral plastics injection molding. According to a further embodiment, the cover may have on its periphery an annularly continuous collar projecting in the axial direction. According to a further embodiment, latching projections and/or latching openings can be provided on the collar of the cover. According to a further embodiment, the connecting device may include an electrically insulating plastics molding, fitted over the contact pins of the piezo actuator, which molding may include openings through which the contact pins can pass and carries integrally molded electrically conductive connecting elements, each associated with one of the openings, which extend in each case from a contacting section adjacent to the associated opening, for contact with the protruding contact pin, to one of the contact pins projecting from the plastics molding. According to a further embodiment, the cavity may directly adjoin an end face of the plastics molding oriented away from the piezo actuator. According to a further embodiment, the plastics molding may contain at least one gas exchange passage. According to a further embodiment, the gas-permeability of the sealing arrangement can be created by a gas-permeable elastomer material. According to a further embodiment, the gas-permeability of the sealing arrangement can be created by a microporous material. According to yet another embodiment, a fuel injector may comprise such an actuating drive.

BRIEF DESCRIPTION OF THE DRAWINGS

The invention is described in more detail below in relation to exemplary embodiments with reference to the appended drawings, in which.

DETAILED DESCRIPTION

Figure 1:
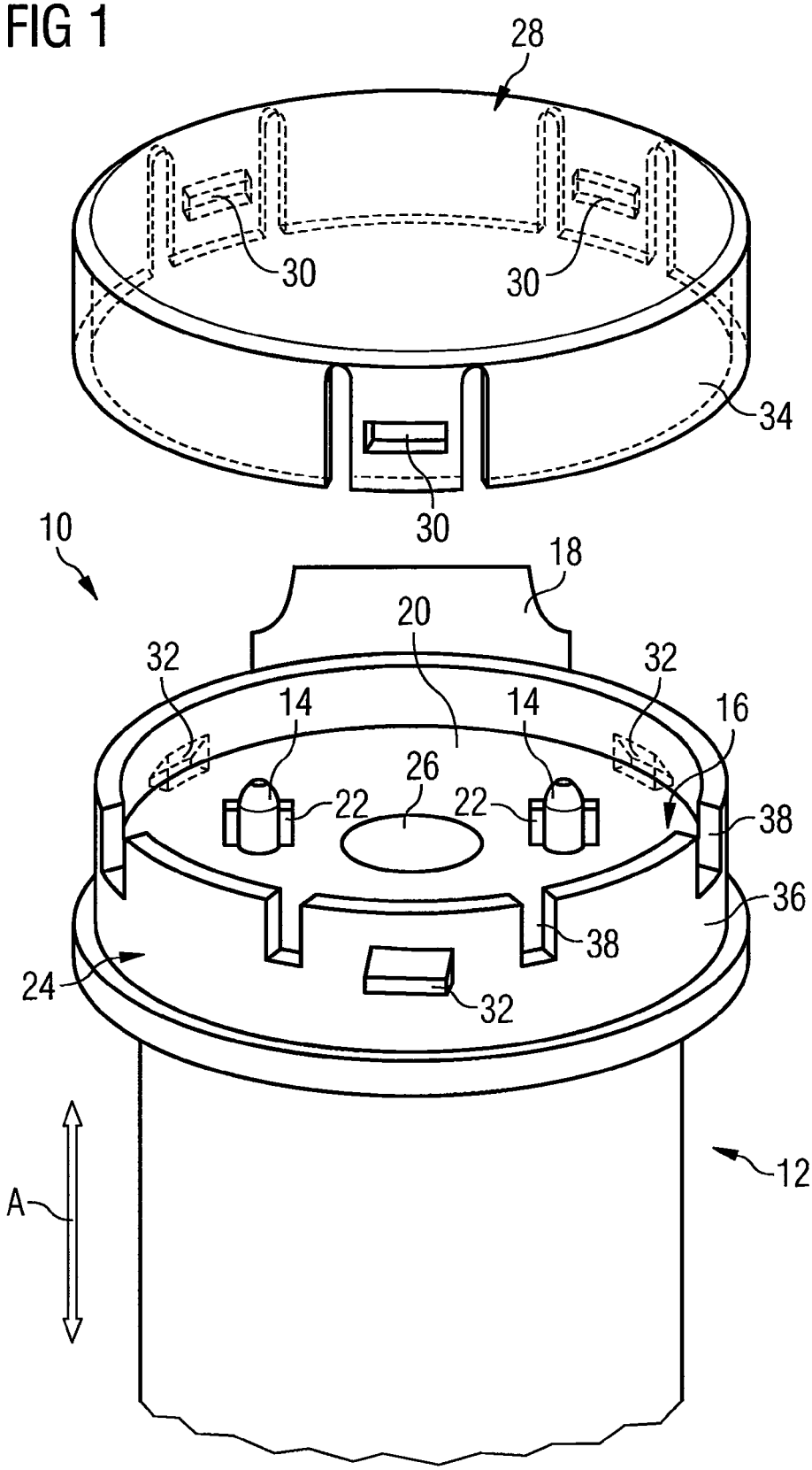
FIG. 1 is a perspective view of an actuating drive in the upper end region thereof.

In the actuating drive according to an embodiment it is provided that the sealing arrangement is embodied in a gas-permeable manner and ends on the outer side in a cavity which is covered by a cover retained on the actuating drive by means of a catch connection.

In trials carried out internally by the applicant it has emerged surprisingly that the arrangement of a piezoceramic component, such as the piezo actuator of interest here, in an actuator housing sealed "as hermetically as possible" in an installation environment containing harmful media, does not in practice prolong the service life of the component but even tends to shorten it.

By contrast, the gas-permeable configuration of the sealing arrangement according to an embodiment leads to a certain "ventilation" of the piezo actuator and therefore to a prolongation of the service life, and enhanced durability, of the piezo actuator.

A possible explanation of the effective mechanism of the actuator ventilation is that, with sealing of the actuator housing which is as hermetic and, in particular, as gas-tight as possible, under certain operating conditions a partial vacuum is produced in the housing interior (for example, by temperature fluctuations), as a result of which harmful media can enter the housing interior through the seal which, in practice, cannot be embodied absolutely hermetically. Other possible explanations are, for example, that, after the production of a hermetically sealed piezo drive, the concentration in the inner chamber of the piezo drive of any gas which shortens service life is increased, or that a filling of the housing interior which resembles atmospheric air has a positive effect on the service life of the piezoelectric ceramics.

At any rate, it has emerged that the promotion of gas exchange between the outside of the actuating drive and the outside of the sealing arrangement tends to prolong service life.

In this respect, simple final injection-molding of plastics material around the sealing arrangement is counterproductive, since such a covering would as a rule hinder the desired gas exchange. It is therefore further provided according to an embodiment that the sealing arrangement opens on the outside into a cavity which is covered by a cover. This configuration of the covering has a positive effect on ventilation of the piezo actuator, a catch connection being provided for fixing the cover to the actuating drive, so that assembly of the cover is especially simple.

The outside of the cover may also advantageously be used for inscription, such inscription being possible both before and after installation of the cover, for example, by means of an inscription laser.

In a preferred embodiment it is provided that the cover has latching projections and/or latching openings which cooperate, for latching, with corresponding latching openings and/or latching projections provided on an integral plastics injection molding. If the cover is installed for latching substantially in the axial direction of the actuating drive, radial latching projections or latching openings are especially appropriate. To simplify latching in this case, these projections and/or openings may be configured with suitable oblique faces (guide ramps). Such radial projections or openings may also be provided in radially resilient form on the cover or on the area of the actuating drive for connection to the cover.

An integral plastics injection molding provided for connecting the cover may, for example, annularly surround an end section of the lateral surface of a sleeve-shaped actuator housing and form a collar projecting in the axial direction beyond the end opening of the actuator housing. The cover may rest against such a collar and/or be latched thereto. It is accordingly provided in an embodiment that the corresponding latching openings and/or latching projections of the integral plastics injection molding are provided on the collar of the integral plastics injection molding.

It can also be advantageous if the cover has on its periphery an annular circumferential collar projecting in the axial direction, which in the assembled state can cooperate, for example, with the collar of the integral plastics injection molding provided on the actuating drive, for example, by abutment and/or by latching. Accordingly, latching projections and/or latching openings may be provided on the collar of the cover.

The connecting device may include in a manner known per se an electrically insulating plastics molding placed on the contact pins of the piezo actuator, which molding includes openings through which the contact pins can pass and carries molded-in electrically conductive connecting elements, each associated with one of the openings, which connecting elements extend in each case from a contacting section adjacent to the associated opening, for contact with the contact pin protruding through said opening, to one of the connecting pins projecting from the plastics molding.

With the use of such an electrical connecting device, the cavity provided according to an embodiment may directly adjoin an end face of the plastics molding oriented away from the piezo actuator. In this case it may be advantageous in promoting gas exchange if the plastics molding includes at least one gas exchange passage.

The gas-permeable embodiment of the sealing arrangement may be realized in various ways. For example, the gas-permeability of the sealing arrangement may be created by a gas-permeable elastomer material (for example, silicone material, in particular fluorosilicone material) and/or a microporous material (for example, expanded polytetrafluoroethylene (ePTFE). In the simplest case, such materials may be used at precisely the locations at which sealing elements (for example, sealing rings, etc.) are located in conventional sealing arrangements.

A fuel injector provided with the actuating drive according to an embodiment is especially suited for use in an installation environment containing "harmful media". Such an environment is produced, in particular, if a fuel injector and at least one further component of a fuel injection system are arranged substantially completely inside an engine block assembly of the internal combustion engine. This refers, in particular, to the case in which components of the injection system which might be arranged outside an engine block assembly without detriment to their operation are housed inside said engine block assembly. The term "engine block assembly" refers here to the totality of the engine components containing lubricating oil, that is, the "engine block" in the narrower sense and attached components (for example, a cylinder head cover, etc.), in which the engine lubricating oil is pumped or lubricates or is supplied/returned. With this design there is an increased danger of ingress of harmful media (engine oil, fuel-diluted engine oil, water, or vapors thereof) into the interior of the fuel injector.

FIG. 1 shows an actuating drive 10 for actuating a fuel injection valve (not shown). The actuating drive 10 forms, together with the fuel injection valve, a fuel injector for injecting fuel into the combustion chamber of an internal combustion engine.

The actuating drive 10 comprises a sleeve-shaped metal actuator housing 12 with a piezoelectric actuator (abbreviation: "piezo actuator") contained therein, from which contact pins 14 project upwardly (axial direction A) from an end opening of the actuator housing 12 through a contact carrier 16 pushed onto the contact pins 14.

The contact carrier 16 serves as a connecting device for the further electrical connection of the contact pins 14 of the piezo actuator to connection pins of a plug connector 18. The plug connector 18 is an external connection device by means of which the actuating drive 10 and the fuel injector formed therewith can be connected to an external activation line arrangement (for example, wiring harness in a motor vehicle) in order to activate the piezo actuator in the desired manner for the injection of fuel.

Only the housing of the plug connector 18 can be seen in the Figure, which housing contains the required external connection pins which extend as electrically conductive elements through a plastics molding 20 of the contact carrier 16, up to contacting sections in the form of welding lugs 22, to which the contact pins 14 have been welded after installation of the contact carrier 16.

After this welding step for contacting of the piezo actuator, an end section of the lateral surface of the sleeve-shaped actuator housing 12 was provided circumferentially with an annular integral plastics injection molding 24 which fixes the installed contact carrier 16 in its position and at the same time integrally forms the housing of the plug connector 18.

In the region of the electrical connecting device (contact carrier 16) or below same a sealing arrangement for sealing the end opening of the actuator housing 12 against the ingress of liquid media is provided.

A special feature of this sealing arrangement is that it is embodied in a gas-permeable manner and therefore makes possible a gas exchange between the installation environment of the fuel injector and the actuator space in which the piezo actuator is contained. This ventilation of the piezo actuator is further promoted by a comparatively large gas exchange opening 26 in the plastics molding 20.

Directly adjoining the upper side of the plastics molding 20 is a cavity which is covered by a cover 28 retained on the actuating drive 10 by means of a catch connection. In the Figure, this cover 28, formed as a plastics injection molding, is shown still separate from the other visible actuating drive components, but forms an (upper) end closure thereof on the finished fuel injector.

The cover 28 has latching openings 30 which, for latching, are brought into engagement with latching projections 32 provided correspondingly on the integral plastics injection molding 24. The cover 28 is retained by this latching on the actuating drive 10, the aforementioned cavity remaining between the cover 28 and the upper side of the contact carrier 16.

In the embodiment represented the cover 28 has three latching openings 30 arranged equidistantly in the circumferential direction, which each project on a resilient tab projecting downwardly in the axial direction A of the one-piece cover. In the circumferential direction between these resilient tabs the material of the cover 28 forms an annular circumferential collar 34, interrupted by the resilient tabs, projecting downwardly in the axial direction A and having a comparatively thin wall thickness.

In the latched state this collar 34 of the cover 28 extends around a correspondingly formed, axially upwardly projecting collar 36 of the integral plastics injection molding 24. The external diameter of the collar 36 corresponds approximately to the internal diameter of the collar 34.

During assembly of the actuating drive 10, the cover 28 is installed from above in the axial direction A, so that the free ends of the resilient tabs on the cover 28 impinge against the upper sides of the latching projections 32 on the integral plastics injection molding 24 and are flexed radially outwardly because the upper sides of said projections 32 are configured as oblique faces and finally, upon flexing back, reach a latched state in which the radially outwardly projecting projections 32 come into engagement with the latching openings 30. In this situation (not represented) the cover 28 is retained reliably on the actuating drive 10 and protects the actuating drive components located below it, in particular the contact carrier 16 with its projecting welded connection between the ends of the contact pins 14 and the ends of the welding lugs 22.

During assembly, therefore, each resilient tab containing the v"window" 30 flexes outwards radially, and snaps over the fixed "hook" 32 of the integral plug molding 24.

The end covering realized by means of the latchable cover 28 can be advantageously compatible with the desired gas exchange capability and, in terms of manufacturing technology, can be simple to produce, for example, as a plastics injection molding.

It is worth mentioning that the attachment of the cover by means of latching has no negative influences on the components (for example, the piezo actuator) already mounted on or in the actuating drive. In this respect, latching is superior to, for example, ultrasound welding between cover and housing arrangement, which is possible in principle.

Although a final, complete encapsulation of the contact carrier 16 with injection-molded plastics material is dispensed with in the actuating drive 10 represented, the contact carrier 16 is nevertheless adequately fixed in position since injection molding around its outer peripheral region is entirely sufficient for such fixing.

During the injection molding process the space situated above the centre of the contact carrier 16 is left open and may remain as an advantageous cavity in the finished actuating drive. A gas exchange capability sufficient in practice between this cavity and the outside of the actuating drive 10 (the installation environment) is already ensured by the latching principle described, since larger or smaller gaps always remain between the material of the cover 28 and the integral plastics injection molding 24; although these gaps prevent ingress of solid objects into the cavity, they do not prevent gas exchange to the degree which is of interest here.

The gas exchange capability between the cavity below the cover 28 and the outside of the actuating drive 10 can, however, be further increased by providing the integral plastics injection molding 24 and/or the cover 28 with gas exchange passages. In the embodiment illustrated, gas exchange openings 38, for example, are provided in the collar 36 of the integral plastics injection molding 24. Alternatively or additionally, such openings may be provided in the cover 28. In particular if such openings are provided in the axially downwardly projecting collar 34 of the cover 28, they can cooperate with corresponding openings in the collar 36 to form "labyrinth-like" passages, for example.

Further ventilation passages may also be provided as gaps remaining between the latching projections and the latching openings after latching thereof.

It will be understood that the latching between the cover and the upper end of the actuating drive housing arrangement, and any ventilation passages in the attachment area, can be realized in various ways. To illustrate this, further embodiments will be described below, although they are again to be understood only as examples.

In the following description of further exemplary embodiments the same reference characters are used for analogous components, but are supplemented by a lower-case letter to distinguish the embodiments. In this description, essentially only the differences from the exemplary embodiment or embodiments already described will be discussed and, furthermore, reference is expressly made here to the description of preceding exemplary embodiments.

Figure 2:
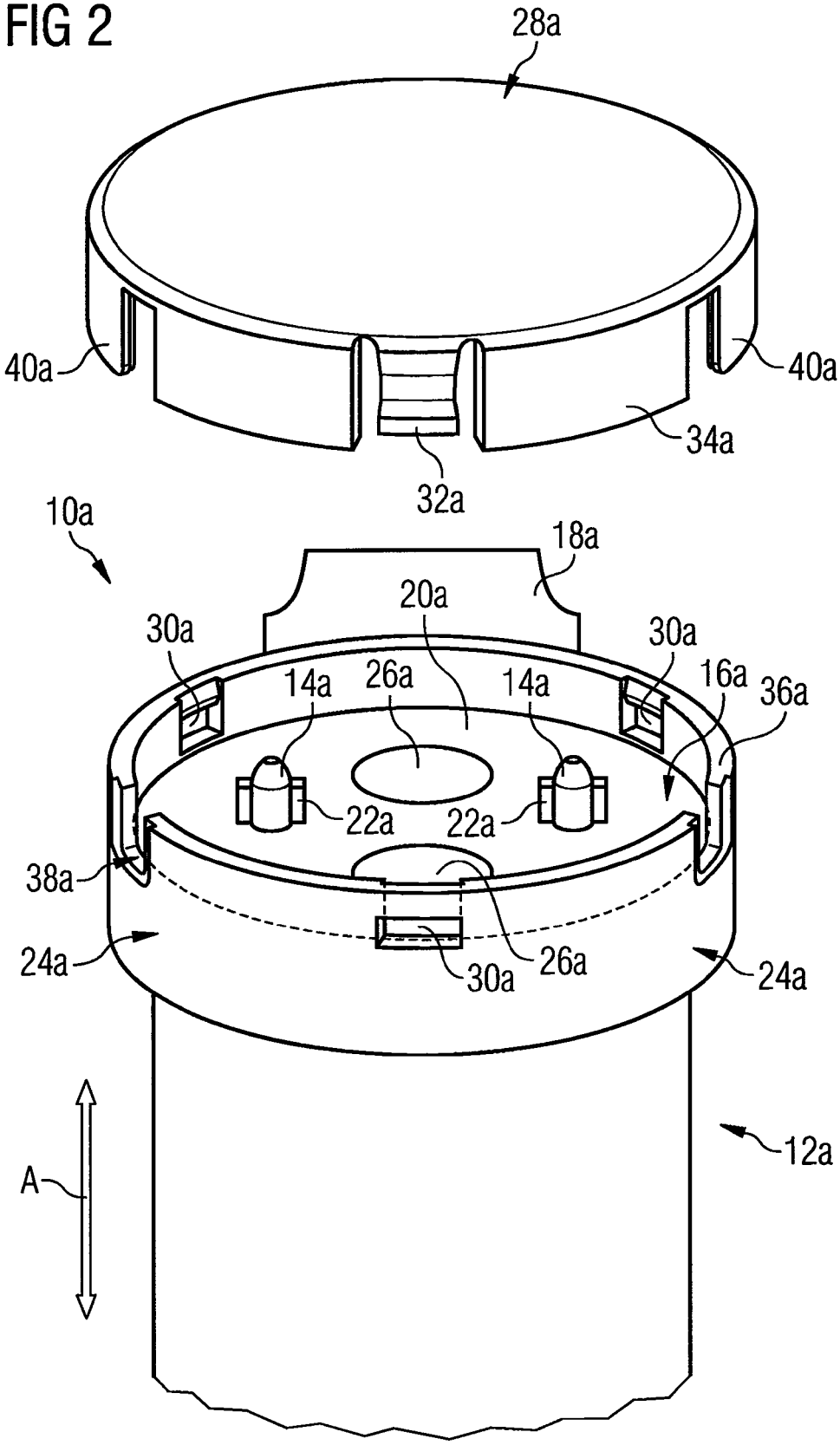
FIG. 2 is a view corresponding to FIG. 1 according to a further embodiment.

FIG. 2 shows an actuating drive 10*a* with a cover 28*a* which again is fixed by latching during assembly of the actuating drive.

In this exemplary embodiment, axially downwardly projecting resilient tabs of the cover 28*a* are provided on their free ends with radially outwardly facing latching projections 32*a* which, for latching, move into engagement with radial latching openings 30*a* in an integral plastics injection molding 24*a*. The "hooks" 32*a* of the cover 28*a* are flexed elastically somewhat towards the inside during assembly and snap into the fixed "windows" 30*a* in the integral plug injection molding 24*a*. Guide ramps to facilitate snapping-in are provided on the upper edges of the openings 30*a* of the collar 24*b* on the inner side of the collar 24*b*.

A further difference from the embodiment described with reference to FIG. 1 is that the external diameter of the collar 34*a* provided circumferentially on the edge of the cover and projecting downwardly corresponds approximately of the internal diameter of the collar 36*a* on the housing arrangement. When the cover 28*a* is fitted, the collar 34*a* of the cover therefore overlaps the housing collar 36*a* on the inner side thereof.

Finally, the collar 36*a* of the integral plastics injection molding 24*a* has two gas exchange openings 38*a* with "stepped opening areas". On the outer periphery of the collar 36*a* the opening area is comparatively large (approximately rectangular and open towards the top), whereas it is adjoined via a step in the opening edge by a smaller opening area which opens into the cavity below the cover 28*a*. The cover 28*a* has at the corresponding locations on its outer peripheral edge two axially downwardly projecting screens 40*a* which substantially cover the openings 38*a* once the cover has been fitted, although a labyrinth-like gap (gas exchange path) remains in each case between the approximately U-shaped peripheral edge of the opening 38*a* and the screen 40*a*. For this purpose the configuration of the screens 40*a* is adapted to the stepped peripheral face of the openings 38*a*.

The labyrinth-like configuration of the outer ventilation passage formed in cooperation with the screens 40*a* reliably prevents ingress of solid objects into the interior of the cover. In addition, this configuration makes it possible for any liquid, such as engine oil, which may have penetrated the cavity below the cover 28*a*, to flow out freely again through gravity.

Figure 3:
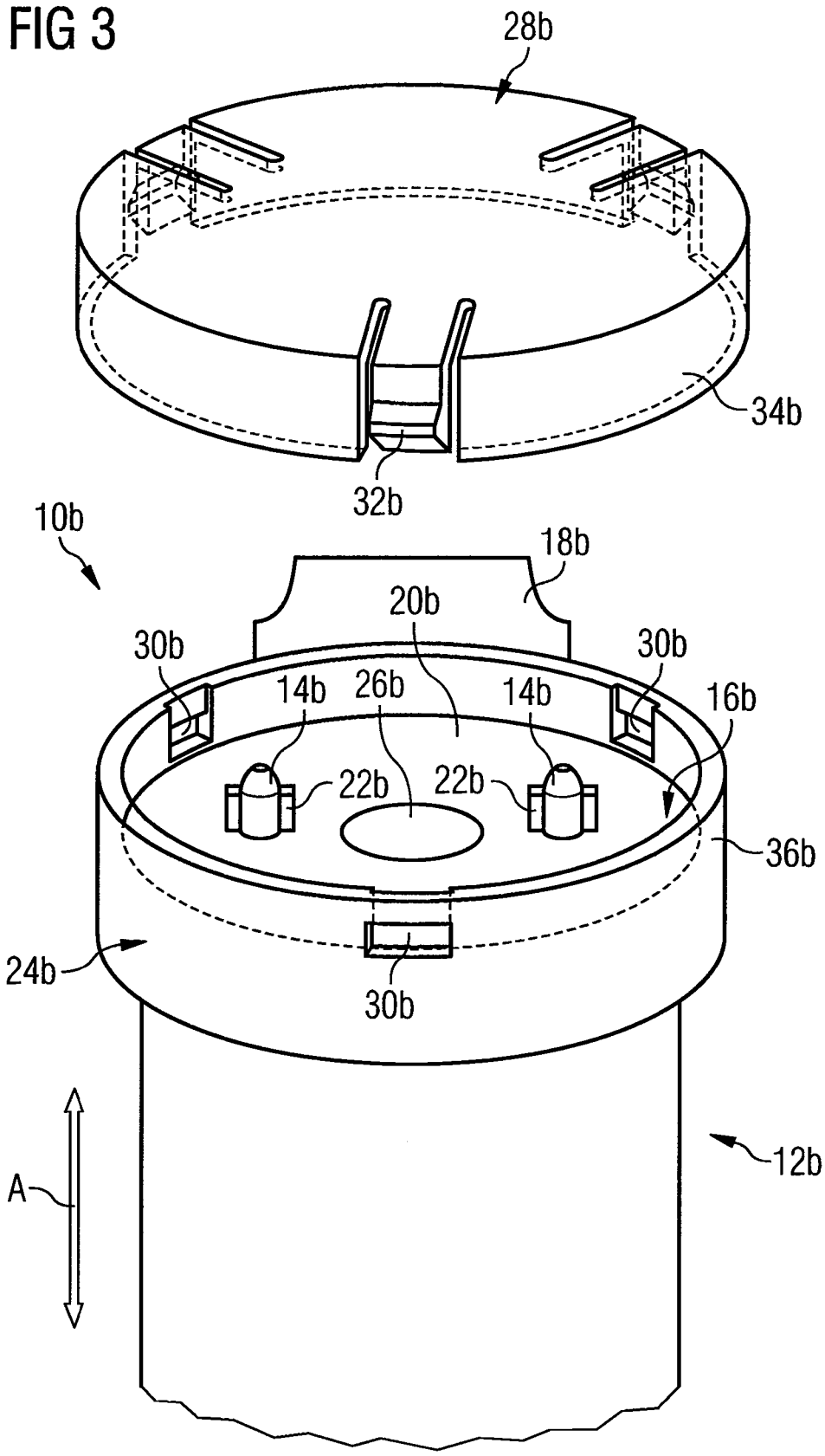
FIG. 3 is a view corresponding to FIG. 1 according to a further embodiment.

FIG. 3 shows an actuating drive 10*b* with a cover 28*b* which, similarly to the embodiment described with reference to FIG. 2, is provided on its outer periphery with three latching projections 32*b* which cooperate with corresponding latching openings 30*b* of an integral plastics injection molding 24*b*.

To improve a spring effect of the projections 32*b*, in this embodiment the corresponding resilient tabs extend into the upper side of the cover 28*b*. In addition to an effectively increased length of the resilient tabs, this configuration results in ventilation passages on the upper side of the cover, which optionally may be supplemented by further ventilation passages of the type described above.

In this variant provision is made to effectively increase the bending length of the "snap hook" 32*b* combined with an extremely compact configuration in the axial direction.

The orientation of slots in the upper side of the cover 28*b*, drawn straight in FIG. 3, might also be provided in an oblique (not radial) and/or curved direction, in deviation from the exemplary embodiment illustrated.

FIG. 4 again clarifies the configuration of a labyrinth-like gas exchange passage formed by covering of a stepped gas exchange opening 38*c* in the collar 36*c* of an integral plastics injection molding 24*c* with a correspondingly stepped screen 40*c* of the cover 28*c*.

In addition, in this embodiment a peripheral collar 34*c* projecting comparatively little in the axial direction is provided on the cover 28*c*, which collar 34*c* does not rest against the collar 36*c* inside or radially outside the latter, but comes into engagement with a corresponding groove in the upper side of the collar 36*c* when the cover 28*c* is fitted.

Figure 4:
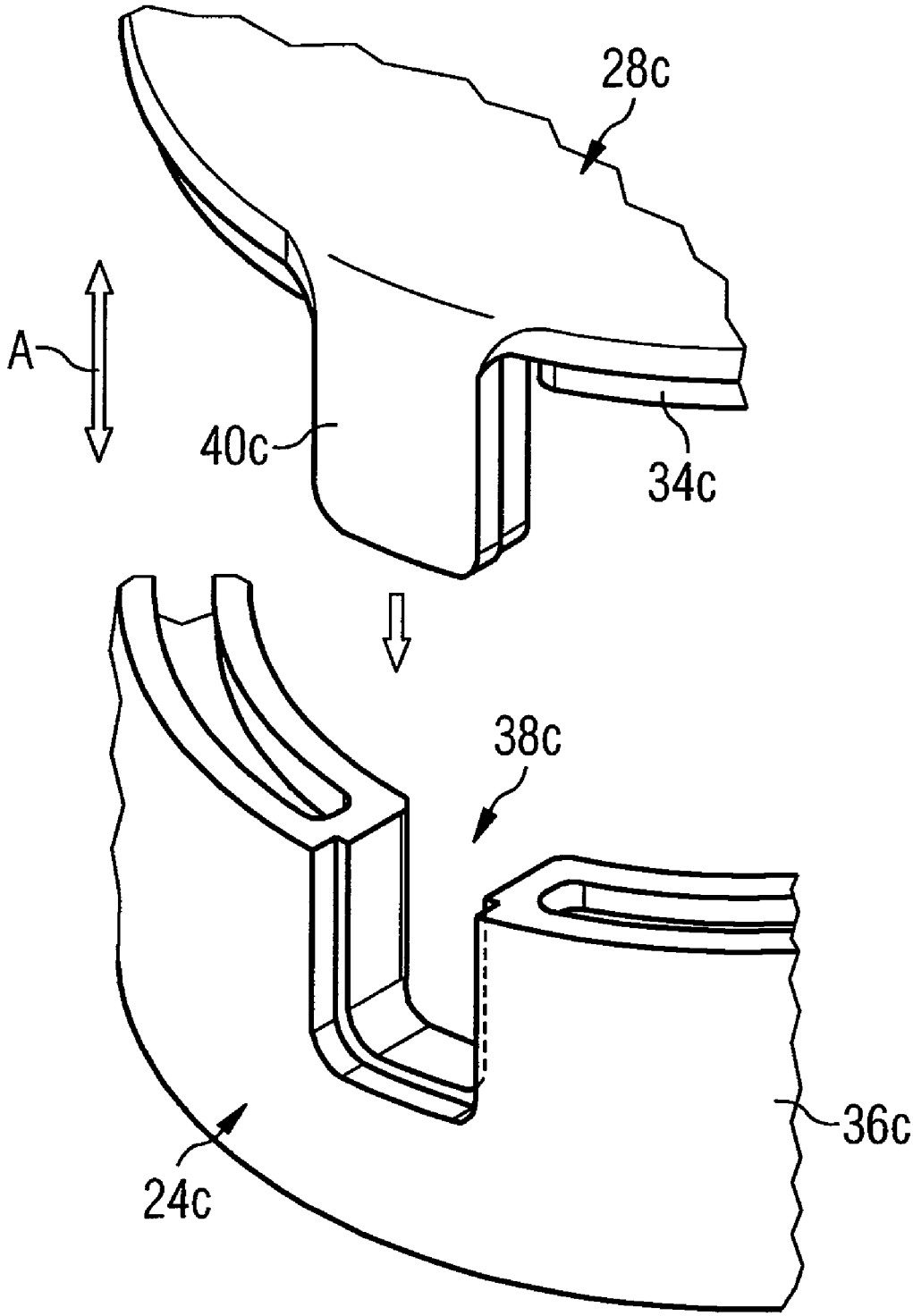
FIG. 4 is a perspective view to clarify a possible ventilation configuration for an actuating drive.

The means for latching the cover 28*c*, provided on the cover on the one hand and on the integral plastics injection molding 24*c* on the other, are not shown in FIG. 4 and may be provided, for example, as in the embodiments described above.

For all the above-described embodiments it is the case that the installed cover does not have a sealing function but provides only protection against coarse soiling of and damage to the components located below it. At the same time, the cover provides protection against touching of the electrical contacts located below it.

By means of the design configuration of the latching means which has been explained (for example, as "snap-in hooks" with corresponding "windows"), a simple and robust connection can be provided which cannot be released without auxiliary means. Through the extremely simple assembly step of pressing the components together, it is achieved with certainty that the piezo actuator located inside the actuating drive will not be damaged. To summarize, the following advantages are obtained in particular:

- simple and inexpensive realization of a mechanical covering of the actuating drive
- inexpensive assembly
- largely free choice of material pairing. The functional characteristics of the cover material can be considered almost independently of the type of assembly connection (latching). If a resilient effect is provided for the latching means provided on the cover, as in the above-described embodiments, the cover material, or the material provided in the region of said cover latching means, need only have a certain elasticity.
- increased durability of the installed piezo actuator by ensuring ventilation
- The cover provides mechanical protection but at the same time, with appropriate configuration, ensures that engine oil and air can flow through the cavity located below the cover.
- No ingress of "solid objects" into the region of the electrical contacting of the piezo actuator, thereby ensuring reliable electrical operation.

To summarize, a simple protective covering can be created, which can be used as universally as possible, for components of a contacting and/or sealing arrangement of an actuating drive in the case of a piezo-actuated actuating drive for actuating a fuel injection valve. To this end it is provided that the sealing arrangement is embodied in a liquid-tight but gas-permeable manner and opens on the outside into a cavity which is covered by a cover retained on the actuating drive by means of a catch connection.

What is claimed is:

1. An actuating drive for actuating a fuel injection valve, comprising a sleeve-shaped actuator housing with a piezo actuator contained therein, from which piezo actuator contact pins project from an end opening of the actuator housing, a connecting device for electrically connecting the contact pins of the piezo actuator to connecting pins of an external connection device formed by the connecting device, and a sealing arrangement for sealing the end opening of the actuator housing against ingress of liquid media, wherein the sealing arrangement is embodied in gas-permeable form and opens on the outside into a cavity which is covered by a cover retained on the actuating drive by means of a catch connection.

2. The actuating drive according to claim 1, wherein the cover has latching projections and/or latching openings which cooperate for latching with latching openings and/or latching projections provided correspondingly on an integral plastics injection molding.

3. The actuating drive according to claim 2, wherein the integral plastics injection molding annularly surrounds an end section of a lateral face of the sleeve-shaped actuator housing and forms a collar projecting beyond the end opening of the actuator housing in the axial direction.

4. The actuating drive according to claim 3, wherein the corresponding latching openings and/or latching projections of the integral plastics injection molding are provided on the collar of the integral plastics injection molding.

5. The actuating drive according to claim 1, wherein the cover has on its periphery an annularly continuous collar projecting in the axial direction.

6. The actuating drive according to claim 5, wherein latching projections and/or latching openings are provided on the collar of the cover.

7. The actuating drive according to claim 1, wherein the connecting device includes an electrically insulating plastics molding, fitted over the contact pins of the piezo actuator, which molding includes openings through which the contact pins can pass and carries integrally molded electrically conductive connecting elements, each associated with one of the openings, which extend in each case from a contacting section adjacent to the associated opening, for contact with the protruding contact pin, to one of the contact pins projecting from the plastics molding.

8. The actuating drive according to claim 7, wherein the cavity directly adjoins an end face of the plastics molding oriented away from the piezo actuator.

9. The actuating drive according to claim 7, wherein the plastics molding contains at least one gas exchange passage.

10. The actuating drive according to claim 1, wherein the gas-permeability of the sealing arrangement is created by a gas-permeable elastomer material.

11. The actuating drive according to claim 1, wherein the gas-permeability of the sealing arrangement is created by a macroporous material.

12. A fuel injector, comprising an actuating drive for actuating a fuel injection valve, comprising a sleeve-shaped actuator housing with a piezo actuator contained therein, from which piezo actuator contact pins project from an end opening of the actuator housing, a connecting device for electrically connecting the contact pins of the piezo actuator to connecting pins of an external connection device formed by the connecting device, and a sealing arrangement for sealing the end opening of the actuator housing against ingress of liquid media, wherein the sealing arrangement is embodied in gas-permeable form and opens on the outside into a cavity which is covered by a cover retained on the actuating drive by means of a catch connection.

13. The fuel injector according to claim 12, wherein the cover has latching projections and/or latching openings which cooperate for latching with latching openings and/or latching projections provided correspondingly on an integral plastics injection molding.

14. The fuel injector according to claim 13, wherein the integral plastics injection molding annularly surrounds an end section of a lateral face of the sleeve-shaped actuator housing and forms a collar projecting beyond the end opening of the actuator housing in the axial direction.

15. The fuel injector according to claim 14, wherein the corresponding latching openings and/or latching projections of the integral plastics injection molding are provided on the collar of the integral plastics injection molding.

16. The fuel injector according to claim 12, wherein the cover has on its periphery an annularly continuous collar projecting in the axial direction.

17. The fuel injector according to claim 16, wherein latching projections and/or latching openings are provided on the collar of the cover.

18. The fuel injector according to claim 12, wherein the connecting device includes an electrically insulating plastics molding, fitted over the contact pins of the piezo actuator, which molding includes openings through which the contact pins can pass and carries integrally molded electrically conductive connecting elements, each associated with one of the openings, which extend in each case from a contacting section adjacent to the associated opening, for contact with the protruding contact pin, to one of the contact pins projecting from the plastics molding.

19. The fuel injector according to claim 18, wherein the cavity directly adjoins an end face of the plastics molding oriented away from the piezo actuator.

20. The fuel injector according to claim 18, wherein the plastics molding contains at least one gas exchange passage.

* * * * *